US006884555B2

(12) United States Patent
Kitani et al.

(10) Patent No.: US 6,884,555 B2
(45) Date of Patent: Apr. 26, 2005

(54) ELECTROSTATIC IMAGE DEVELOPING TONER, PRODUCTION METHOD THEREOF AND IMAGE FORMING METHOD

(75) Inventors: Tomoe Kitani, Hino (JP); Hiroshi Yamazaki, Hachioji (JP); Ken Ohmura, Hachioji (JP)

(73) Assignee: Konica Corporation, Tokyo (JP)

( * ) Notice: Subject to any disclaimer, the term of this patent is extended or adjusted under 35 U.S.C. 154(b) by 55 days.

(21) Appl. No.: 10/408,031

(22) Filed: Apr. 3, 2003

(65) Prior Publication Data

US 2003/0203300 A1 Oct. 30, 2003

(30) Foreign Application Priority Data

Apr. 12, 2002 (JP) ..... 2002-110302
Apr. 17, 2002 (JP) ..... 2002-114593

(51) Int. Cl.[7] ..... G03G 9/097
(52) U.S. Cl. ..... 430/45; 430/108.1; 430/124
(58) Field of Search ..... 430/45, 108.1, 430/124, 137.15

(56) References Cited

U.S. PATENT DOCUMENTS 3,855,166 A * 12/1974 Fukuda et al. ..... 430/109.1
5,760,124 A * 6/1998 Listigovers et al. ..... 524/505
2001/0051309 A1 * 12/2001 Nagahama et al. .... 430/108.23

* cited by examiner

*Primary Examiner*—John L Goodrow
(74) *Attorney, Agent, or Firm*—Squire, Sanders & Dempsey

(57) ABSTRACT

An electrostatic image developing toner is disclosed. The toner is composed of a colored particle containing a compound represented by Formula (1).

Ar-L-R (1)

In the formula Ar is an aryl group, R is an aryl or alkyl group and L is —$CH_2$—, —$(CH_2)_2$—,

14 Claims, 1 Drawing Sheet

ELECTROSTATIC IMAGE DEVELOPING TONER, PRODUCTION METHOD THEREOF AND IMAGE FORMING METHOD

FIELD OF THE INVENTION

The present invention relates to an electrostatic image developing toner which exhibits improved storage stability as well as improved fixing off-setting properties, a production method thereof, and an image forming method.

BACKGROUND OF THE INVENTION

In digital copiers and laser printers, in order to obtain high quality images more approaching conventional photography, high gloss images preferred are which are produced employing toner comprised of smaller diameter particles. In order to decrease the toner particle diameter, production of toner particles according to a polymerization method has received attention.

In copiers and the like, which utilize the electrophotographic process described above, it is required that a non-fixed toner image formed on a recording sheet is fixed to obtain a permanent image. Known as such fixing methods are a solvent fixing method, a pressure fixing method, and a thermal fixing method.

Employed as thermal fixing methods are a thermal contact type heating roller system which exhibits high heat efficiency as well as high safety and a film heating system which saves energy.

Thermal fixing apparatuses, which utilize the thermal contact fixing method, are comprised of a heating roller (being a fixing roller) and a pressure roller which is arranged to come into pressure contact with the fixing roller. The heating roller is comprised of a cored cylinder which comprises a heat lamp in its interior and a heat-resistant releasing layer is formed on its outer circumferential surface. The pressure roller is also compromised of a cored metal cylinder and a heat-resistant elastic material layer is formed on its outer circumferential surface. In conventional thermal fixing systems, supports such as plain paper sheets having a pre-fixed toner image are allowed to pass between both rollers to which a definite pressure is applied whereby fixing is carried out. A heating roller type fixing apparatus which utilizes the system exhibits higher thermal efficiency compared to those utilizing other fixing systems such as a hot air fixing system or an oven fixing system, whereby, at present, the fixing apparatus is most widely employed due to lower power consumption, higher production rate, and reduced fire hazard due to paper jamming.

However, in the contact heating roller system fixing apparatus, which employs a heating roller (being a rotating member for fixing), when transfer materials and toners are heated by a heating roller having a halogen heater in its interior, it is necessary to heat the fixing heating roller which has a high heat capacity. As a result, problems occur in which the life of the heating rubber roller is shortened due to the increase in temperature of the interior of the elastic layer, energy saving is adversely affected due to lower energy saving effects, and when printing is initiated, the time necessary for print initiation (being a warming-up period) increases due to an increase in time for warming up the fixing apparatus.

In recent years, in order to overcome the problems, the fixing unit described below has become commercially available. An on-demand type-fixing unit, comprised of a combination of a ceramic heater having a small heat capacity and film, has been realized. Namely, during stand-by, electricity is applied to the heater only for preliminary heating, and only when necessary, for example, as when paper sheets are supplied, electricity is supplied to the heater.

However, in the on-demand fixing system, employing a seamless film the problems described below have occurred. Electrostatic off-setting phenomena occur in which toner on a transfer material is electrostatically transferred onto the fixing roller or the fixing film. Further, the bleeding efficiency of releasing agents from toner decrease due to a lower fixing load, compared to the conventional fixing systems, whereby off-setting tends to occur. Particularly, fixing members are stained by slight off-setting, which is not detected on images, resulting in a decrease in life. Due to these drawbacks, fixing apparatuses employing the system have not been applied commonly to high speed printers or to high speed copiers.

Recently, in order to achieve energy saving systems, low temperature fixing techniques have been noted. However, when taking into account an increase in speed of printing process at low temperature, specifically off-setting properties are greatly affected depending on the characteristics of the employed toners. In the low temperature fixing system, problems occur in which when the toner comprised of conventional resins is employed, cold off-setting tends to occur due to excessively high elasticity. On the other hand, when as a characteristic of resins, elasticity is designed to be much lower than the necessary value, it becomes difficult to achieve compatibility between off-setting resistance and storage stability of toner due to coagulation and fusion of toner during storage.

SUMMARY OF THE INVENTION

An object of the present invention is to provide an electrostatic image developing toner which exhibits excellent toner storage stability, a wide fixing temperature range, excellent off-setting resistance as well as fixability, a production method thereof, and an image forming method.

1. An electrostatic image developing toner which comprises a compound represented by Formula (1).

$$\text{Ar-L-R} \qquad (1)$$

In the formula Ar is an aryl group, R is an aryl or alkyl group and L is $—CH_2—$, $—(CH_2)_2—$,

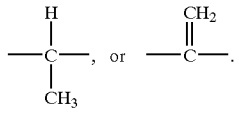

2. An electrostatic image developing toner which comprises a compound represented by Formula (1) in an amount of 0.001 to 1.0 percent by weight.
3. An electrostatic image developing toner which is prepared via a process in which a resin is produced by polymerizing a polymerization monomer in a water based medium.
4. A production method of an electrostatic image developing toner which comprises a process in which a resin is produced by polymerizing a polymerization monomer in a water based medium.
5. In an image forming method comprising a process in which an electrostatic image is formed on an electrostatic image bearing body, a process in which a toner image is formed by developing said electrostatic toner image, employing a developer comprising an electrostatic image developing toner, as well as a process in which said toner image is transferred onto a transfer body, an image forming method wherein said electrostatic image developing toner is an electrostatic image developing toner described in any of items 1. through 3.

DETAILED DESCRIPTION OF THE INVENTION

Figure 1:
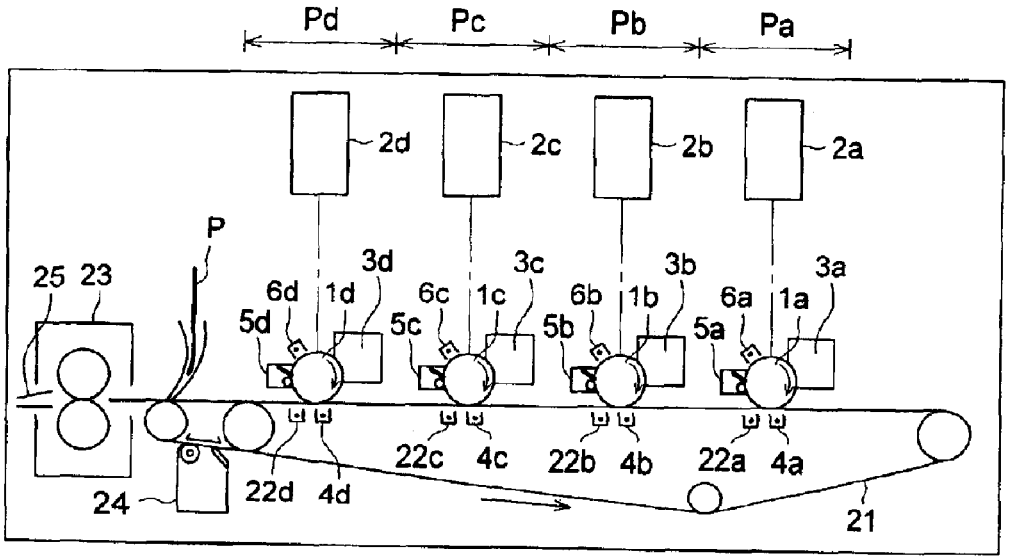
FIG. 1 is a schematic view of the image forming apparatus in which an intermediate transfer material is provided.

The toner of the invention comprises colored resin particles and optionally other additives. The colored resin particle comprises a resin binder, a colorant, and a compound of the Formula (1) incorporated in the resin binder.

The inventors of the present invention performed diligent investigation to specifically improve off-setting resistance at low temperature fixing as well as storage stability of toner. As a result, it has been found that is both fixability at a low temperature and storage stability of toner are improve by incorporating the compound represented by the Formula (1) in the interior of toner particles. The compound renders the toner resin flexible adequately.

The compounds represented by Formula (1) will now be described.

In Formula (1), as Ar a phenyl group or a naphthyl group which may have a substituent such as an aliphatic hydrocarbon group having 1 to 10 carbon atoms can be exemplified. As R, an aryl group or an aliphatic hydrocarbon group having 1 to 10 carbon atoms can be exemplified.

In one of the embodiments of the invention the compound is represented by General Formula (2) $R_1$—$(Ar_1)_n$.

In General Formula (2), $R_1$ represents a divalent or higher valent aliphatic hydrocarbon group having 1 to 10 carbon atoms, $Ar_1$ represents a phenyl group or a naphthyl group having an unsubstituted or substituted $R_2$, wherein $R_2$ represents a hydrogen atom or an aliphatic hydrocarbon group having 1 to 10 carbon atoms, and n represents an integer of 2 to 4.

Listed as the aliphatic hydrocarbon groups having 1 to 10 carbon atoms, represented by $R_1$, are, for example, a methylene group, an ethylene group, a trimethylene group, an allylene group, a tetramethylene group, a pentamethylene group, a hexamethylene group, a methoxyethylene group, an ethoxyethylene group, an ethyleneoxy group, an ethylenethio group, a phenetylene group, a 2-trofluoromethylethylene group, a 2,2,3,3-tetrafluoroethylene group, a carbamoylethylene group, a hydroxyethylene group, a 2-(2-hydroxyethoxy)ethylene group, a phenylene group, and a naphthylene group.

Of these, preferred are a methylene group, an ethylene group, a trimethylene group, a tetramethylene group, a pentamethylene group, a tetramethylene group, and an ethyleneoxy group. Of these, an ethylene group is most preferably employed.

Further, $R_2$ represents an aliphatic hydrocarbon group having 1 to 10 carbon atoms and includes, for example, a straight-chain, branched-chain, or cyclic alkyl group (including a cycloalkyl group and an aralkyl group, for example, a methyl group, an ethyl group, a propyl group, a butyl group, a hexyl group, an octyl group, a decyl group, a dodecyl group, an isopropyl group, an isobutyl group, an isopentyl group, a tert-butyl group, a 2-ethylhexyl group, a cyclopropyl group, a cyclobutyl group, a cyclopentyl group, and a cyclohexyl group), an alkenyl group (for example, a vinyl group, a 2-propenyl group, a 3-butenyl group, a 1-methyl-3-propenyl group, a 3-pentenyl group, a 1-methyl-3-butenyl group, and a 4-hexyenyl group), and an alkenyl group (for example, a vinyl group, a 2-propenyl group, and a 3-butenyl group), an alkynyl group (for example, a 2-propynyl group, and 3-butynyl group).

In another embodiment of the invention the compound is an aromatic hydrocarbon compound having 9 or more, preferably not more than 20 carbon atoms. The aromatic hydrocarbon compound has a substituent whose example includes an alkyl, aryl, aralkyl, alkenyl, alkynyl, acyl, alkoxycarbonyl, aryloxycarbonyl, sulfo, carboxyl, hydroxyl, alkoxy, aryloxy, amide, sulfamoyl, carbamoyl, ureido, amino, sulfonamide, sulfonyl, cyano, nitro, mercapto, alkylthio and arylthio group and halogen atom.

The preferable aromatic hydrocarbon compound is benzene or naphthalene having an aliphatic hydrocarbon group having 3 or more carbon atoms.

Listed as specific examples of the compounds are n-propylbenzene, isopropylbenzene, n-butylbenzene, n-pentylbenzene, n-hexylbenzene, and methylstyrene.

The specific examples of the compounds represent by Formula (1), according to the present invention, are listed below.

1.

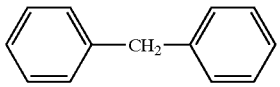

2.

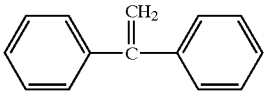

3.

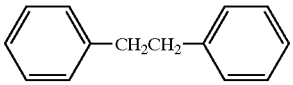

4.

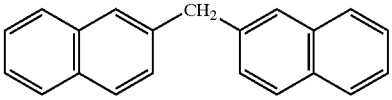

5.

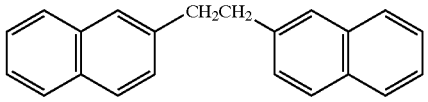

6.

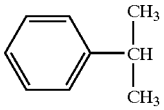

7.

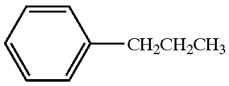

8.

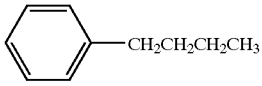

-continued

9.

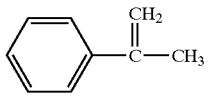

The most preferable examples are diphenylmethane, 1,1-diphenyl ethylene, isopropyl benzene and α-methylstyrene.

The compounds according to the present invention are easily synthesized but are also commercially available.

The compounds represented by Formula (1), according to the present invention, are customarily added to the electrostatic image developing toner in an amount of 0.001 to 1.0 percent by weight, preferably from 0.003 to 0.1 percent by weight, and more preferably 0.005 to 0.1 percent by weight with respect to the electrostatic image developing toner. The resulting electrostatic image developing toner exhibits appropriate softness, and degradation of the storage stability of the toner as well as decrease in fixing ratio is minimized employing such an amount.

The compounds according to the present invention, are mainly added during the polymerization process, and are finally incorporated in toner particles in an amount of 70 to 100 percent with respect to the total added amount.

The compound may be added in any step of polymerization when the toner resin particles are prepared by multi-step polymerization. It is preferred to add whole amount of the compound in the second step polymerization when the toner resin particles are prepared by three-step polymerization.

Alternatively, the compounds, which are raw materials of the compounds, may be added during each of the toner preparation processes so as to be present as compounds according to the present invention after completion of toner preparation. In such cases, when compounds employed as raw materials function as chain transfer agents such as α-methylstyrene dimer, they may be preferably employed to result in the formation of the desired molecular weight distribution.

It is possible to confirm the content amount of the added compound in the toner, employing a detection method such as an inner standard method, which is employed in common gas chromatography while employing a head space system gas chromatography. In this method, a toner is sealed in a container and heated to near the temperature during thermal fixing in the copier. When the container is filled with the volatile components, gases in the container are ejected into gas chromatograph, whereby the volatile components are measured and MS (mass spectrometry) is also carried out.

The head space gas chromatographic measurement method will now be described.

<Head Space Gas Chromatographic Measurement Method>

1. Sampling Samples

Charged in a 20-ml vial for head space is 0.8 g of a sample. The weight of the sample is measured to the second decimal of 0.01 (since it is necessary to calculate the area per unit weight). The vial is sealed with a septum.

2. Heating Samples

Samples are placed in a thermostat at 170° C. so that each vial remains erect and are heated for 30 minutes.

3. Setting of Gas Chromatograph Separation Conditions

A column having an inner diameter of 3 mm and a length of 3 m, filled with carriers which are coated with silicone oil SE-30 so as to achieve a weight ratio of 15 is employed as a separation column. The resulting separation column is installed in the gas chromatograph, and He, as a carrier, is allowed to flow at a rate of 50 ml/minute. The separation column is heated to 40° C. and subsequently measurements are carried out while increasing the temperature to 260° C. at a rate of 15° C./minute. After reaching 260° C., the temperature is maintained for 5 minutes.

4. Introduction of Sample

The vial is removed from the thermostat, and immediately 1 ml of gas, generated from the sample, is collected employing a gas tight syringe. Subsequently, the collected gas is injected into the above mentioned column.

5. Calculation

In advance, a calibration curve is prepared employing an aromatic hydrocarbon compound utilized as an inner standard material. The concentration of each component is determined based on the corresponding calibration curve.

6. Apparatuses and Materials (1) Head Space Conditions

Head Space Apparatus

HP7694 "Head Space Sampler" manufactured by Hewlett-Packard Corp.

Temperature Conditions

Transfer line: 200° C.

Loop temperature: 200° C.

Sample Amount: 0.8 g/20 ml vial (2) GC/MS Conditions

GC: HP5890 manufactured by Hewlett-Packard Corp.

MS: HP5971 manufactured by Hewlett-Packard Corp.

Column: HP-624 30 m×0.25 mm

Oven temperature: 40° C. (3 minutes)–15° C./minute–260° C.

Measurement mode: SIM

The electrostatic image developing toner of the present invention and the production method thereof will now be described.

<Production Method of Resin Particles>

In the most representative production method, resin particles are prepared by polymerizing polymerizable monomers in a water-based medium. In the production method, fine resin particles are prepared by emulsion-polymerizing monomers in a medium (usually a water-based medium) to which an emulsified composition, comprising necessary additives, or by carrying out mini-emulsion polymerization. If desired, colorants, fixing improving agents such as release agents, and charge control agents, are added. Subsequently, aggregation and fusion are carried out by adding the coagulants, such as salts.

<Suspension Polymerization>

One example of the method for producing the toner of the present invention is as follows. Various types of components such as colorants, and if desired, release agents, and polymerization initiators are added into polymerizable monomers, and subsequently, the various types of components are dissolved in or dispersed into the polymerizable monomers, employing a homogenizer, a sand mill, a sand grinder, or an ultrasonic homogenizer. The resulting monomers, which comprise dissolved or dispersed components, are dispersed into a water-based medium, employing a homomixer or a homogenizer so as to form oil droplets, having the specified size as toner particles.

Thereafter, the resulting dispersion is placed in a reaction apparatus (being a stirring apparatus), which is fitted with stirring mechanisms, which refer to the stirring blade described below, and undergoes reaction while being heated. As a result, fine resin particles are prepared. Subsequently, the coagulants such as salts are added and the resin particles are aggregated and fused. Thereafter, the resulting toner particles are separated, washed, the impurities in the toner particles are removed, and dried, whereby the toner of the present invention is prepared. The term "water-based medium" is used to refer to a medium which is comprised of at least 50 percent of water by weight.

<Emulsion Polymerization>

Further, listed as a method for producing the toner of the present invention may be a method in which resin particles are prepared employing an emulsion polymerization method and the resulting particles are aggregated and fused. There is no limitation for the method. However, listed as methods may be those described, for example, in Japanese Patent Application Open to Public Inspection Nos. 5-265252, 6-329947, and 9-15904.

Thereafter, as previously described, resin particles and constituting materials, such as colorants, are aggregated and fused, and subsequently, heated to a temperature higher or equal to the glass transition point so as to be fused. The preferable processes are as follows. The resulting particles are dispersed in water, employing emulsifiers. Thereafter, the resulting dispersion is salted out by adding coagulants in an amount of at least the critical aggregation concentration. The resulting polymer is heated to higher or equal to the glass transition temperature, and preferably, the particle size is allowed to gradually increase. When the particle size reaches the specified value, the aggregation terminating agents are added so as to terminate an increase in particle size. Further, during heating and stirring, the particle surface is smoothed and the particle shape is controlled. Subsequently, the resulting particles are separated from the dispersion and heat dried, whereby it is possible to form the toner of the present invention. Incidentally, herein, in order to efficiently proceed with fusion, solvents such as alcohols, which are infinitely soluble in water, may be simultaneously added.

The following method is preferably employed for the preparation of the toner of the invention. The method comprises a salting-out/fusing process of colorant particles and composite resin particles prepared by polymerization of polymerizable monomer which may contain the compound of the Formula according to the invention. The compound can be contained in the monomer in a dissolved state or melted state. A releasing agent may be also incorporated in the monomer solution.

Further, in the production method of the toner of the present invention, it is preferable that fine composite resin particles, which are prepared employing a multiple step polymerization method, and fine colorant particles are aggregated and fused. The multiple step polymerization is described below.

(Preparation Method of Composite Resin Particles Prepared by a Multiple Step Polymerization Method)

The production method of the toner of the present invention is preferably comprised of the processes described below.

The preferable production process preferably comprises the following processes:

(1) Multi-step polymerization which prepare composite resin particles.
(2) Salting out, coagulation and fusion process in which composite resin particles and colorant particles are subjected to salting out, coagulation and fusion to obtain colored resin particles.
(3) Filtration and washing process in which colored resin particles are separated from the dispersion and the colored resin particles are washed out to remove a surfactant etc.
(4) Drying process in which the washed colored resin particles are subjected to drying.
(5) Addition process of external additive to the colored resin particles.

Each step is described.

(Multi-step Polymerization)

The multiple step polymerization method, as described herein, refers to the polymerization method which expands the molecular weight distribution of resin. Namely, in order to form phases having different molecular weight distributions in one resin particle, polymerization reaction is carried out while dividing into multiple steps so that in the resulting resin particle, the molecular weight gradient is formed from the center of the particle to its surface layer. For example, a method is employed in which after preparing a dispersion comprised of high molecular weight resin particles, a low molecular weight surface layer is formed by newly adding polymerizable monomers as well as chain transfer agents.

In the present invention, from the viewpoint of the production stability and improved crushing resistance of the resulting toner, it is preferable to employ the multiple step polymerization method comprised of at least three steps. Two-step and three-step polymerization methods, which are representative examples of the multiple step polymerization method, will now be described. In toner which is prepared by such a multiple step polymerization reaction, from the viewpoint of the crushing resistance, it is preferable that resins having a lower molecular weight are increasingly employed while approaching the surface layer.

<Two-step Polymerization Method>

The two-step polymerization method is a method to prepare composite resin particles which are comprised of a central portion (being a nucleus) comprised of high molecular weight resins and an outer layer (being a shell) comprised of low molecular weight resins.

This method will now be specifically described. Initially, a monomer solution is prepared, the compound of the invention or crystalline materials may be dissolved in monomers. After dispersing the resulting monomer solution into a water-based medium (for example, an aqueous surface active agent solution) so as to form oil droplets, the resulting system is subjected to a polymerization treatment (the first step polymerization), whereby a dispersion of high molecular weight resin particles is prepared.

Subsequently, polymerization initiators and monomers to prepare low molecular weight resins are added to the resulting resin particle dispersion, and the monomers undergo polymerization (the second step polymerization) in the presence of the resin particles, whereby a covering layer, comprised of the low molecular weight resins (the polymers of monomers), is formed.

<Three-step Polymerization Method>

The three-step polymerization method is a method to prepare composite resin particles which are comprised of a central portion (being a nucleus) comprised of high molecular weight resins, an interlayer and an outer layer (being a shell) comprised of low molecular weight resins. The toner particle of the present invention is formed as the composite resin particle.

This method will now be specifically described. Initially, a dispersion comprised of resin particles, which have been prepared by polymerization (the first step polymerization) according to a conventional method, is added to a water-based medium (for example, an aqueous surface active agent solution). After dispersing a monomer solution into the water-based medium so as to form oil droplets, the resulting system undergoes polymerization (the second step polymerization), whereby a covering layer (an interlayer) comprised of resins is formed on the surface of resin particles (nucleus particles). Thus a composite resin particle (comprised of high molecular weight resins and intermediate molecular weight resins) dispersion is prepared.

Subsequently, polymerization initiators and monomers to prepare a low molecular weight resin are added to the resulting composite resin particle dispersion, and the monomers undergo polymerization (the third step polymerization) in the presence of the composite resin particles, whereby a covering layer comprised of a low molecular weight resin (a polymer of the monomers) is formed.

In the production method of the toner, polymerizable monomers are preferably polymerized in a water-based medium. Namely, the method is such that during formation of nucleus particles or the covering layer (the interlayer), resin particles are prepared by dispersing a monomer solution into a water-based medium so as to form oil droplets, and finally carrying out polymerization by adding polymerization initiators to the resulting system.

The water-based media, as described in the present invention, refer to media comprised of water in an amount of 50 to 100 percent by weight and water-soluble organic solvents in an amount up to 50 percent by weight. Exemplified as water-soluble solvents may be, for example, methanol, ethanol, isopropanol, butanol, acetone, methyl ethyl ketone, and tetrahydrofuran. Of these, preferred are alcohol based organic solvents, which do not dissolve the prepared resins.

A method suitable for forming a resin particle or cover layer containing a functional material such as a compound according to the invention or a releasing agent is preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the functional material dissolved in oil phase tends to desorb. On the other hand sufficient amount of the functional material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers.

The diameter of dispersed particles is 10 to 1,000 nm, and is preferably 50 to 1,000 nm and particularly preferably 30 to 300 nm.

The diameter of the composite resin particles prepared by the polymerization process is the weight average particle diameter, determined employing an Electrophoretic Light Scattering Spectrophotometer "ELS-800" (manufacture by OTSUKA ELECTRONICS CO., LTD.), and is preferably in the range of 10 to 1,000 nm.

Further, the glass transition temperature (Tg) of the composite resin particles is preferably in the range of 40 to 74° C., and is more preferably in the range of 42 to 64° C.

Still further, the softening pint of the composite resin particles is preferably in the range of 95 to 140° C.

The toner of the invention can be obtained by forming a resin layer on the surface of the particles of a resin and a colorant by means of salting-out/fusing. The method is detailed below, Salting Out, Coagulation and Fusion In the process of salting out, coagulation and fusion composite resin particles obtained by multi-step polymerization and colorant particles are subjected to salting out, coagulation and fusion wherein salting out and fusion are caused simultaneously, to obtain aspherical colored resin particles.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) are subjected to coagulation preferably in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

Further, in the present invention, the total concentration of divalent (or trivalent) metal elements employed in coagulants and univalent metal elements added as coagulation inhibiting agents, described below, is preferably from 350 to 35,000 ppm by weight.

It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

<Filtration and Washing Process>

In the filtration and washing process, filtration is carried out in which said colored resin particles are collected from the colored resin particle dispersion, and washing is also carried out in which additives such as surface active agents, salting-out agents, and the like, are removed from the collected colored resin particles (a cake-like aggregate). Filtering methods are not particularly limited, and include a centrifugal separation method, a vacuum filtration method which is carried out employing Buchner funnel and the like, a filtration method which is carried out employing a filter press, and the like.

<Drying Process>

The drying process is one in which said washed colored resin particles are dried.

Listed as dryers employed in this process may be spray dryers, vacuum freeze dryers, vacuum dryers, and the like. Further, standing tray dryers, movable tray dryers, fluidizedbed layer dryers, rotary dryers, stirring dryers, and the like are preferably employed.

It is proposed that the moisture content of dried toners is preferably not more than 5 percent by weight, and is more preferably not more than 2 percent by weight.

Aggregates may be subjected to crushing treatment when dried colored resin particles are aggregated due to weak attractive forces among particles. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colorant particles is added to the dispersion of the compound resin particles and the compound resin particles and the colorant particles are salted-out and coagulated.

In the procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the colored resin particle since the polymerization reaction for forming the compound resin particle is completely performed. Consequently, any offensive odor is not occurred in the fixing process by heating in the image forming method using such the toner.

The surface property of thus produced colored resin particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of composition elements employed in the toner production processes will now be detailed.

<Polymerizable Monomers>

Employed as polymerizable monomers to prepare resins (binders), employed in the present invention, are hydrophobic monomers as an essential composition element and if desired, crosslinkable monomers. Further, it is preferable that at least one kind of monomers having an acidic polar group or a basic polar group in the structure, as shown below, is incorporated.

(1) Hydrophobic Monomers

Hydrophobic monomers, which constitute a monomer component, are not particularly limited, and conventional monomers known in the art may be employed. Further, the monomers may be employed individually or in combination of at least two types so as to realize desired characteristics.

Specifically employed may be monovinyl aromatic based monomers, (meth)acrylic acid ester based monomers, vinyl ester based monomers, vinyl ether based monomers, monoolefin based monomers, diolefin based monomers, or halogenated olefin based monomers.

Listed as vinyl aromatic based monomers may be, for example, styrene based monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrne, and 3,4-dichlorostyrne, and derivatives thereof.

Listed as (meth)acrylic acid ester based monomers my be acrylic acid, methacrylic acid, methyl acrylate, ethyl acrylate, butyl acrylate, acrylic acid-2-ethylhexyl, cyclohexyl acrylate, phenyl acrylate, methyl methacrylate, ethyl methacrylate, butyl methacrylates, hexyl methacrylates, methacrylic acid-2-ethylhexyl, ethyl β-hydroxyacrylate, propyl γ-aminoacrylate, stearyl methacrylates, dimethyl aminoethyl methacrylates, and diethyl aminoethyl methacrylate.

Listed as vinyl ester based monomers may be vinyl acetate, vinyl propionate, and vinyl benzoate, while listed as vinyl ether monomers may be vinyl methyl ether, vinyl ethyl ether, vinyl isobutyl ether, and vinyl phenyl ether.

Further, listed as monoolefin based monomers may be ethylene, propylene, isobutylene, 1-butene, 1-pentene, and 4-methyl-1-pentene, while listed as diolefin based monomers ma be butadiene, isoprene, and chloroprene.

(2) Crosslinkable Monomers

In order to improve the characteristics of resin particles, crosslinkable monomers may be incorporated. Listed as crosslinkable monomers are, for example, monomers such as divinylbenzne, divinylnaphthalene, divinylether, diethylene glycol methacrylate, ethylene glycol methacrylate, polyethylene glycol dimethacrylate, and diallyl phthalate, all of which have at least two unsaturated bonds.

(3) Monomers Having an Acidic Polar Group

Listed as monomers having an acidic polar group may be α,β-ethylenic unsaturated compounds having a carboxylic group (—COOH) and α,β-ethylenic unsaturated compounds having a sulfonic group (—$SO_3H$).

Listed as examples of α,β-ethylenic unsaturated compounds having a carboxylic group may be acrylic acid, methacrylic acid, fumaric acid, maleic acid, itaconic acid, cinnamic acid, monobutyl maleate, monooctyl maleate, and metal salts thereof, such as Na salts and Zn salts.

Listed as examples of α,β-ethylenic unsaturated compounds having a sulfonic group may be sulfonated styrene and Na salts thereof, and allylsulfosuccinic acid and octyl allylsulfosuccinate and Na salts thereof.

(4) Monomers Having a Basic Polar Group

Demonstrated as monomers having a basic polar group may be (meth)acrylic acid esters of aliphatic alcohols, having an amine group or a quaternary ammonium group, which have from 1 to 12 carbon atoms, preferably from 2 to 8 carbon atoms, and more preferably 2 carbons atoms; (meth)acrylic acid amides or (meth)acrylic acid amides which are subjected to mono or di-substitution on optional carbon atom(s) with an alkyl group having from 1 to 18 carbon atoms; vinyl compounds substituted with a heterocyclic group having N as a ring member; and N,N-diallylalkylamines or quaternary ammonium salts thereof. Of these, preferred as monomers having a basic polar group are (meth)acrylic acid esters of aliphatic alcohols having an amine group or a quaternary ammonium group.

Listed as examples of (meth)acrylic acid esters of aliphatic alcohols having an amine group or a quaternary ammonium salt may be dimethyl aminoethyl acrylate, dimethyl aminoethyl methacrylate, diethyl aminoethyl acrylate, diethyl aminoethyl methacrylate, quaternary ammonium salts of the four compounds, 3-dimethylaminophenyl acrylate, and 2-hydroxy-3-methacryloxypropyltrimethl ammonium salt.

Listed as (meth)acrylic acid amides which are subjected to mono- or di-substitution on optional carbon atom(s) with an alkyl group may be acrylamide, N-butylacrylamide, N,N-dibutylacrylamide, piperidylacrylamide, methacrylamide, N-butylmethacrylamide, N,N-dimethylacrylamide, and N-octadecylacrylamide.

Listed as vinyl compounds substituted with a heterocyclic group having N as a ring member may be vinylpyridine, vinylpyrrolidone, vinyl-N-methylpyridinium chloride, and vinyl-N-ethylpyridinium chloride.

Listed as examples of N,N-diallyl-alkylamines may be N,N-diallylmethylammonium chloride and N,N-diallylammonium chloride.

(Initiator)

In the present invention, radical polymerization initiators may suitably be employed, as long as they are water-soluble. Listed as those are, for example, persulfates (for example, potassium persulfate and ammonium persulfate, azo based compounds (for example, 4,4-azobis-4-cyanovaleric acid and salts thereof), and peroxide compounds. Further, if desired, the radical polymerization initiators may be combined with reducing agents so as to be used as a redox system initiator. The use of the redox system initiators results in advantages such as an increase in polymerization activity, a decrease in polymerization temperatures, and a decrease in polymerization time.

Polymerization temperatures are not particularly limited, as long as they are higher or equal to the minimum radical formation temperature of the polymerization initiator, and are, for example, in the range of 50 to 90° C. However, by employing polymerization initiators comprised of a hydrogen peroxide-reducing agent (such as ascorbic acid) combinations, which are capable of initiating polymerization at room temperature, it is possible to carry out polymerization at room temperature or higher.

<Chain Transfer Agent>

A chain transfer agent may be used for the purpose of adjusting the molecular weight. Listed as preferred compounds may be propyl thioglycolate, butyl thioglycolate, t-butyl thioglycolate, 2-ethylhexyl thioglycolate, octyl thioglycoate, decyl thioglycolate, dodecyl thioglycolate, ethylene glycol having a mercapto group and derivatives thereof; neopentyl glycol having a mercapto group and derivatives thereof; pentaerythritol having a mercapto group and derivatives thereof; and a styrene dimer. Of these, n-octyl-3-mercaptopropionic acid esters and styrene dimer are particularly preferred. Two or more chain transfer agent can be employed in combination.

<Surface Active Agents>

In order to carry out mini-emulsion polymerization employing the polymerizable monomers, it is preferable that oil droplet dispersion is carried out in a water-based medium, employing surface active agents. Surface active agents usable for the dispersion are not particularly limited, however, it is possible to list ionic surface active agents as examples of suitable compounds.

Listed as ionic surface active agents are, for example, sulfonates (sodium dodecylbenzenesulfonate, sodium arylalkylpolyethersufonate, sodium 3,3-disulfonedophenylurea-4,4-diazo-bis-amino-8-naphthol-6-sulfonate, ortho-carboxybenzene-azo-dimethylaniline, and sodium 2,2,5,5-tetramethyl-triphenylmethane-4,4-diazo-bis-β-naphthol-6-sulfonate), sulfuric acid ester salts (sodium dodecylsulfonate, sodium tetradecylsulfonate, sodium pentadecylsulfonate, and sodium octylsulfonate), and aliphatic acid salts (sodium oleate, sodium laurate, sodium caprate, sodium caprylate, sodium caproate, potassium stearate, and calcium oleate).

Further, in the present invention, it is possible to employ nonionic surface active agents, which specifically include polyethylene oxide, polypropylene oxide, combinations of polypropylene oxide and polyethylene oxide, esters of polyethylene glycol with higher fatty acids, alkylphenol polyethylene oxide, esters of higher fatty acid with polyethylene glycol, esters of higher fatty acids with polypropylene oxides, and sorbitan esters.

In the present invention, these surface active agents are employed mainly as an emulsifier during emulsion polymerization. However, they may be employed in other processes or for other purposes.

<Resin Particles and Molecular Weight Distribution of Toner Particles>

It is preferable that the peak or shoulder of the molecular weight distribution is in the range of 100,000 to 1,000,000 and 1,000 to 50,000. Further, it is more preferable that the peak or shoulder of the peak is in the range of 100,000 to 1,000,000, 25,000 to 150,000, and 1,000 to 50,000.

It is preferable that resins are comprised of high molecular weight components having a molecular weight peak or shoulder in the range of 100,000 to 1,000,000 and low molecular weight components having a molecular weight peak or shoulder in the range of 1,000 to 50,000. It is more preferable to use intermediate molecular weight resins having a peak or shoulder in the range of 15,000 to 100,000.

The molecular weight of the toner or resins is preferably determined employing GPC (gel permeation chromatography) in which THF (tetrahydrofuran) is employed as a solvent. Namely, 0.5 to 5.0 mg of a measured sample, or specifically 1.0 mg of the sample, is added to 1 mg of THF, and is completely dissolved at room temperature while employing a stirrer such as a magnetic stirrer. Subsequently, the resulting solution is treated employing a membrane filter with a pore size of 0.45 to 0.50 μm, and is then injected into GPC. Measurement conditions of GPC are as follows. A column is stabilized at 40° C. THF is then flowed at a rate of 1.0 ml per minute and measurement is carried out by injecting 100 μl of a sample at a concentration of 1 mg/ml. Commercially available polystyrene gel columns are preferably employed upon being combined. For example, listed may be combinations of Shodex GPC KF-801, -802, -803, -804, -805, -806, and -807, manufactured by Showa Denko Co., as well as combinations of TSK-GEL G1000H, G2000H, G3000H, G4000H, G5000H, G6000H, and G7000H, and a TSK guard column, manufactured by Tosoh Corp. Further, it is preferable to use a refractive index detection apparatus (an IR detection apparatus) or a UV detection apparatus. During the measurement of the molecular weight of the sample, the molecular weight distribution of the sample is determined employing a calibration curve which has been prepared by employing standard monodispersed polystyrene particles. It is preferable that the calibration curve be drawn employing 10 differing polystyrene particle sizes.

(Coagulants)

The coagulants employed in the present invention are preferably selected from metallic salts.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application. Generally, the critical coagulation concentration (coagulation value or coagulation point) of divalent metallic salts is less than that of monovalent metallic salts. Furthermore, the critical coagulation concentration of trivalent metallic salts is lowered.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The polymer particles dispersion liquid is processed by employing metal salt so as to have density not less than critical coagulation density. In this instance the metal salt is added directly or in a form of aqueous solution optionally, which is determined according to the purpose. In case that it is added in an aqueous solution the metal salt must satisfy the critical coagulation density including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

<Colorants>

The toner of the present invention is preferably prepared by aggregating and fusing the composite resin particles and colorant particles.

Listed as colorants (colorant particles which are aggregated and fused with the composite resin particles) may be various types of inorganic pigments, organic pigments, and dyes. Specific inorganic pigments are exemplified below.

Employed as black pigments are, for example, carbon blacks such as furnace black, channel black, acetylene black, thermal black, and lamp black, as well as magnetic powders such as magnetite and ferrite.

If desired, these inorganic pigments may be employed individually or in combination of a plurality of selected ones. The added amount of these pigments is typically from 2 to 20 percent by weight, and is preferably from 3 to 15 percent.

When employed as magnetic toner, the magnetite may be incorporated. In such cases, from the viewpoint of providing the specified magnetic characteristics, it is preferable that the magnetite be incorporated in the toner in an amount of 20 to 60 percent by weight.

Organic pigments as well as dyes may be employed. Specific examples of organic pigments and dyes are cited below.

Listed as pigments for magenta or red are, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are, for example, C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Listed as pigments for green or cyan are, for example, C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Further, employed as dyes may be, for example, C.I. Solvent Red 1, the same 49, the same 52, the same 58, the same 63, the same 111, and the same 122; C.I. Solvent Yellow 19, the same 44, the same 77, the same 79, the same 81, the same 82, the same 93, the same 98, the same 103, the same 104, the same 112, and the same 162; and C.I. Solvent Blue 25, the same 36, the same 60, the same 70, the same 93, and the same 95. In addition, mixtures thereof may also be employed.

If desired, these pigments as well as these dyes may be employed individually or in combination of a plurality of selected ones. Further, the added amount of pigments is typically from 2 to 20 percent by weight with respect to the polymer, and is preferably from 3 to 15 percent.

Colorants (colorant particles) which constitute the toner of the present invention may be subjected to surface modification. Employed as surface modifiers may be those which are conventionally known in the art. Specifically silane coupling agents, titanium coupling agents, and aluminum coupling agents may preferably be employed. Listed as silane coupling agents are, for example, alkoxysilanes such as methylmethoxysilane, phenylmethoxysilane, methylphenyldimethoxysilnae, diphenyldimethoxysilane, siloxanes such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane. Listed as titanium coupling agents are, for example, TTS, 9S, 38S, 41B, 46B, 55, 138S, and 238S which are manufactured by Ajinomoto-Fine-Techno Co., Inc., and are commercially available under the product name PLENACT, and commercially available products, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, and TTOP, manufactured by Nippon The Co., Ltd. Listed as an aluminum coupling agent is, for example, PLENACT AL-M, manufactured by Ajinomoto-Fine-Techno Co., Inc.

The added amount of these surface modifiers is preferably from 0.01 to 20.00 percent by weight with respect to the colorant, and is more preferably from 0.2 to 5.0 percent.

Further, listed as the surface modification method of colorant particles is a method in which surface modifiers are added to a colorant particle dispersion and the resulting mixture is heated so as to initiate a reaction.

Surface modified colorant particles as above are collected by filtration. Subsequently, the collected particles are subjected to repeated washing and filtration employing the same solvent, and then dried to prepare the final product.

(Release Agents)

Toner employed in the invention comprises aggregation toner particles obtained by salting out/fusing composite resin particles, preferably containing a releasing agent.

Preferred as compounds which exhibit a release function are low molecular weight polypropylene (having a number average molecular weight of 1,500 to 9,000) and low molecular weight polyethylene. Particularly preferred compounds are the ester based compounds represented by the formula described below.

$$R_1—(OCO—R_2)_n$$

Wherein n is commonly an integer of 1 through 4; is preferably 2, 3, or 4; is more preferably 3 or 4; and is most preferably 4; and $R_1$ and $R_2$ each represents a hydrocarbon group which may have a substituent. $R_1$ has commonly from 1 to 40 carbon atoms, preferably from 1 to 20 carbon atoms, and more preferably from 2 to 5 carbon atoms. $R_2$ has commonly from 1 to 40 carbon atoms, preferably from 16 to 30 carbon atoms, and more preferably from 18 to 26 carbon atoms.

Examples of the representative compounds are shown below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)
$$CH_3—(CH_2)_{20}—COO—(CH_2)_2—\overset{\overset{CH_3}{|}}{CH}—CH_2—O—CO—(CH_2)_{20}—CH_3$$

7)
$$CH_3—(CH_2)_{22}—COO—(CH_2)_2—\overset{\overset{CH_3}{|}}{CH}—CH_2—O—CO—(CH_2)_{22}—CH_3$$

8)
$$CH_3—(CH_2)_{22}—COO—CH_2—\underset{\underset{CH_3}{|}}{\overset{\overset{CH_3}{|}}{C}}—CH_2—O—CO—(CH_2)_{22}—CH_3$$

9)
$$CH_3—(CH_2)_{26}—COO—CH_2—\underset{\underset{CH_3}{|}}{\overset{\overset{CH_3}{|}}{C}}—CH_2—O—CO—(CH_2)_{26}—CH_3$$

10)
$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)
$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)
$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

-continued

13)
$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)
$$\begin{array}{l} CH_2—OH \\ | \\ CH—OH \\ | \\ CH_2—O—CO—(CH_2)_{26}—CH_3 \end{array}$$

15)
$$\begin{array}{l} CH_2—OH \\ | \\ CH—OH \\ | \\ CH_2—O—CO—(CH_2)_{22}—CH_3 \end{array}$$

16)
$$CH_3—(CH_2)_{26}—COO—CH_2—\overset{\overset{CH_3}{|}}{\underset{\underset{CH_2—O—CO—(CH_2)_{26}—CH_3}{|}}{C}}—CH_2—O—CO—(CH_2)_{26}—CH_3$$

17)
$$CH_3—(CH_2)_{20}—COO—CH_2—\overset{\overset{CH_2CH_3}{|}}{\underset{\underset{CH_2—O—CO—(CH_2)_{20}—CH_3}{|}}{C}}—CH_2—O—CO—(CH_2)_{20}—CH_3$$

18)
$$CH_3—(CH_2)_{26}—COO—CH_2—\overset{\overset{CH_2—O—CO—(CH_2)_{26}—CH_3}{|}}{\underset{\underset{CH_2—O—CO—(CH_2)_{26}—CH_3}{|}}{C}}—CH_2—O—CO—(CH_2)_{26}—CH_3$$

19)
$$CH_3—(CH_2)_{20}—COO—CH_2—\overset{\overset{CH_2—O—CO—(CH_2)_{20}—CH_3}{|}}{\underset{\underset{CH_2—O—CO—(CH_2)_{20}—CH_3}{|}}{C}}—CH_2—O—CO—(CH_2)_{20}—CH_3$$

20)
$$CH_3—(CH_2)_{18}—COO—CH_2—\overset{\overset{CH_2—O—CO—(CH_2)_{18}—CH_3}{|}}{\underset{\underset{CH_2—O—CO—(CH_2)_{18}—CH_3}{|}}{C}}—CH_2—O—CO—(CH_2)_{18}—CH_3$$

21)
$$CH_3—(CH_2)_{16}—COO—CH_2—\overset{\overset{CH_2—O—CO—(CH_2)_{16}—CH_3}{|}}{\underset{\underset{CH_2—O—CO—(CH_2)_{16}—CH_3}{|}}{C}}—CH_2—O—CO—(CH_2)_{16}—CH_3$$

22)
$$CH_3—(CH_2)_{20}—COO—CH_2—\overset{\overset{CH_2—O—CO—CH_3}{|}}{\underset{\underset{CH_2—O—CO—CH_3}{|}}{C}}—CH_2—O—CO—CH_3$$

The added amount of the compounds is typically from 1 to 30 percent by weight with respect to the total toner, is preferably from 2 to 20 percent, and is more preferably from 3 to 15 percent.

It is preferable to prepare the toner of the invention by a method in which the releasing agent is incorporated in the resin particles by mini-emulsion polymerization and the resin particles are subjected to salting out/fusion as well as colorant particles.

The toner may contain a material giving various function other than the colorant and a releasing agent. Practical example is a charging agent. These materials may be incorporated in the toner by methods in which these materials are added as well as the resin particles and the colorant particles simultaneously during the salting out/fusion process or the materials are added directly in the resin particles.

Various types of charge control agents, which can be dispersed in water, may also be employed. Specifically listed are nigrosine based dyes, metal salts of naphthenic acid or higher fatty acids, alkoxylated amines, quaternary ammonium salts, azo based metal complexes, salicylic acid metal salts or metal complexes thereof.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic.

Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY—C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

(Toner Particles)

Number average diameter of the toner particle is preferably from 3 to 10 $\mu$m, more preferably from 3 to 8 $\mu$m. Particle diameter is controlled by adjusting concentration of coagulant (salting agent), amount of organic solvent, fusing time, composition of polymer during the toner preparation.

Number of fine toner particles having strong adhesion which fly to heating device and generate off-set is reduced, and high transfer performance is obtained whereby image quality of half tone, fine line, dot and so on is improved by employing the toner having average diameter of 3 to 10 $\mu$m.

It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

Herein values are shown which are obtained based on the particle diameter distribution in the range of 2.0 to 40 $\mu$m, employing an aperture having an aperture diameter of 100 $\mu$m of said Coulter Counter TA-II as well as said Coulter Multisizer.

(Preferable Shape Coefficient of Toner Particles)

In the toner of the present invention, it is preferable that the ratio of colored resin particles, having a shape factor in the range of 1.0 to 1.6, is at least 65 percent, more preferably 70 percent by number with respect to the number of all colored resin particles, and further it is preferable that the ratio of colored resin particles, having a shape factor in the range of 1.2 to 1.6, is at least 65 percent, more preferably 70 percent by number with respect to the number of all colored resin particles.

The shape coefficient of the toner particles is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane. The shape coefficient was determined in such a manner that toner particles were photographed under a magnification factor of 2,000, employing a scanning type electron microscope, and the resultant photographs were analyzed employing "Scanning Image Analyzer", manufactured by JEOL LTD. At that time, 100 toner particles were employed and the shape coefficient was obtained employing the aforementioned calculation formula.

The toner of the present invention preferably has a sum M of at least 70 percent. Said sum M is obtained by adding relative frequency ml of toner particles, included in the most frequent class, to relative frequency m2 of toner particles included in the second frequent class in a histogram showing the particle diameter distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

Aperture: 100 μm

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

<Developers>

The toner of the present invention may be employed in either a single component developer or a double component developer.

The single component developer includes a non-magnetic single component developer and a magnetic single component developer in which magnetic particles, having a size of about 0.1 to about 0.5 μm, are incorporated in the toner. The toner of the present invention may be employed in either of these.

Further, the toner of the present invention may be employed in the double component developer upon being mixed with a carrier. In such a case, employed as magnetic particles of the carrier may be materials such as metals, for example, iron, ferrite, and magnetite, and alloys of metals such as aluminum and lead with the metals, which are conventionally known in the art. Of these, ferrite particles are particularly preferred. The volume average particle diameter of the magnetic particles is preferably from 15 to 100 μm, and is more preferably from 25 to 80 μm.

It is possible to determine the volume average particle diameter of a carrier, employing a representative apparatus such as a laser diffraction type particle size analyzer "HELOS" (manufactured by Sympatec Co.) fitted with a wet type homogenizer.

Preferred as carriers are those in which magnetic particles are further coated with resins or so-called resin dispersed type carriers in which magnetic particles are dispersed in resins. Resin compositions for coating are not particularly limited. Employed as such resins are, for example, olefin based resins, styrene based resins, styrene-acryl based resins, silicone based resins, ester based resins, and fluorine-containing polymer based resins. Further, resins employed to constitute the resin dispersed type carrier are not particularly limited, and those known in the art may be employed. For example, employed may be styrene-acryl based resins, polyester resins, fluorine based resins, and phenol based resins.

(Image Forming Method)

An example of an image forming apparatus which can be employed for the image forming method using the toner of he invention.

FIG. 1 is a schematic view of the image forming apparatus in which an intermediate transfer material (transfer belt) is provided.

In the image forming apparatus as shown in FIG. 1 for forming a color image according to the invention, a plurality of image forming units is arranged by each of which visible toner images each having different color is respectively formed and successively transferred in pile onto the same image support member.

In the apparatus, the first, second, third and fourth image forming units Pa, Pb, Pc and Pd are serially arranged and each of the image forming units has an exclusive image carrier or photoreceptor drum 1*a*, 1*b*, 1*c* and 1*d*, respectively. Image forming devices 2*a*, 2*b*, 2*c* and 2*d*, developing devices 3*a*, 3*b*, 3*c* and 3*d*, transfer discharge devices 4*a*, 4*b*, 4*c* and 4*d*, cleaning devices 5*a*, 5*b*, 5*c* and 5*d*, and chargers 6*a*, 6*b*, 6*c* and 6*d*, are respectively arranged around the photoreceptors 1*a* through 1*d*.

In such the constitution, for instance, a latent image of a yellow component of a color original image is firstly formed by the image forming device 2*a* on the photoreceptor drum la of the first image forming unit Pa. The latent image is developed by a developer containing a yellow toner of the developing device 3*a* to be converted to a visible image and the visible image is transferred to the transfer belt 21 by the transfer discharging device 4*a*.

During the yellow image is transferred onto the transfer belt 21, a latent image of magenta component is formed on the photoreceptor drum 1*b* and converted to a visible image by a developer containing a magenta toner by the developing device 3*b* in the second image forming unit Pb. The visible magenta toner image is transferred to the prescribed position on the transfer belt 21 on which the image formed in the first image forming unit Pa is transferred, when the image support member is introduced to the position of the transfer discharging device 4*b*.

Subsequently, the image formation of a cyan component as well as a black component is carried out in the same manner as the method described above, employing third image forming unit Pc and fourth image forming unit Pd. As a result, on said transfer belt, the cyan toner image and the black toner image are superpose-transferred. When said image transfer is finished, a superposed multicolor image is prepared on said transfer belt 21. On the other hand, photoreceptors 1*a*, 1*b*, 1*c*, and 1*d*, which have finished the transfer, are subjected to removal of any residual toner, employing cleaning units 5*a*, 5*b*, 5*c*, and 5*d*, and are then employed to form the next image formation.

Transfer belt 21 is employed in the image forming apparatus. In FIG. 1, said transfer belt 21 is conveyed from right to left. During said conveyance process, said transfer belt 21 passes through each of transfer discharge sections 4*a*, 4*b*, 4*c*, and 4*d* in each of image forming units Pa, Pb, Pc, and Pd, and each color image is transferred.

When transfer belt 21 passes through fourth image forming unit Pd, an AC voltage is applied to separation charge eliminating unit 22*d*, and said transfer belt 21 is subjected to charge elimination, whereby all toner images are simultaneously transferred onto transfer material P.

In FIG. 1, 22*a*, 22*b*, 22*c*, and 22*d* each are a separation charge elimination discharging unit, respectively. Transfer belt 21, which has finished the transfer of toner images, is subjected to removal of the residual toner, employing cleaning unit 24 comprised of a brush type cleaning member in combination with a rubber blade, and is prepared for the next image formation.

Further, as described above, a multicolor superposed image is formed on transfer belt 21 such as a long conveying belt, and the resultant image is simultaneously be transferred onto a transfer material. Alternatively, it may be constituted in such a manner that an independent transfer belt is provided to each of the image forming units, and an image is successively transferred to a transfer material from said each transfer belt.

Further, employed as said transfer belt is a looped film which is prepared as described below. A 5 to 15 μm thick releasing type layer, the surface resistance of which is adjusted to $10^5$ to $10^8\Omega$ by adding conductive agents to a fluorine based or silicone based resin, is provided onto an approximately 20 μm thick high-resistance film comprised of polyether, polyamide or tetrafluoroethylene-perfluorovinyl ether, having a surface resistance of $10^{14}\Omega$ or higher.

In the image forming method of the present invention, as described above, a toner image formed in the development process passes through a transfer process in which said image is transferred onto a transfer material. Subsequently, the transferred image is fixed in a fixing process.

Said heating roller fixing system is constituted of an upper roller and a lower roller. Said upper roller is formed by covering, with tetrafluoroethylene or polytetrafluoroethylene-perfluoroalkoxyvinyl ether copolymers, the surface of a metal cylinder comprised of iron or aluminum, which has a heating source in its interior, and said lower roller is formed employing silicone rubber. The representative example of said heating source is one having a linear heater which heats the surface of said upper roller to about 120 to 200 (C. Pressure between said upper roller and said lower roller is applied in the fixing section and a so-called nip is formed by deformation of said lower roller. The resultant nip width is commonly from 1 to 10 mm, and is preferably from 1.5 to 7 mm. The linear fixing velocity is preferably from 40 to 600 mm/second. When said nip width is less than said lower limit, it becomes difficult to uniformly provide heat to a toner, whereby uneven fixing occurs. On the other hand, when said nip width is greater than said upper limit, problems with excessive off-setting during fixing occur due to the enhancement of melting resins.

Another fixing system such that having a thermal belt as a heating member or having pre-heat mechanism may be employed for the invention than that having a heating roller and a pressure roller described above.

A fixing-cleaning mechanism may be provided. Employed as systems to achieve said mechanism may be a system in which silicone oil is supplied onto the upper fixing roller or film, and a system in which cleaning is carried out utilizing a pad, a roller, or a web each of which are impregnated with silicone oil.

Further, the image forming apparatus, employed in the present invention, may have a mechanism which carries out toner recycling in which a non-transferred toner, which remains on the surface of the photoreceptor, is subjected to recycling. Listed as systems to carry out toner recycling may be, for example, a method in which toner, recovered in the cleaning section, is conveyed employing a conveyer or a conveying screw to a hopper for supplying the toner or a development unit, or is mixed with supply toner in an intermediate chamber and is then supplied to the development unit. Listed as preferred systems may be a system in which recovered toner is directly returned to the development unit, or a system in which recycled toner is mixed with supply toner in the intermediate chamber and is then supplied.

EXAMPLES

The embodiments as well as effects of the present invention will be specifically described with reference to examples.

Example 1

Preparation of Toner 1–7 and Comparative Toner 1

Preparation of Colored Particle 1

(Preparation of Latex)

(1) Preparation of Nucleus Particles (First Step Polymerization)

Charged into a 5,000 ml separable flask fitted with a stirring unit, a temperature sensor, a cooling pipe, and a nitrogen inlet unit was a surface active agent solution (a water-based medium) which was prepared by dissolving 4.0 g of an anionic surface active agent A ($C_{10}H_{21}(OCH_2CH_2)_2OSO_3Na$ in 3,040 g of deionized water. Subsequently, while stirring at 230 rpm, temperature in the flask was raised to 80° C. under a flow of nitrogen.

Added to the resulting surface active agent solution was an initiator solution prepared by dissolving 10.0 g of a polymerization initiator (potassium persulfate: KPS) in 200 g of deionized water, and subsequently, the resulting mixture was heated to 75° C. Thereafter, a monomer mix solution, comprised of 528 g of styrene, 204 g of n-butyl acrylate, and 68.0 g of methacrylic acid, was added dropwise over one hour. While stirring, the resulting system underwent polymerization (first step polymerization) while heated to 75° C. for two hours, whereby resin particles (a dispersion of resin particles comprised of a high molecular weight resin) were prepared. The resulting particles were designated as "Latex (1H)".

(2) Formation of the Interlayer (the Second Step Polymerization)

Charged into a flask fitted with a stirring unit were 95.0 g of styrene, 36.0 g of n-butyl acrylate, 9.0 g of methacrylic acid, and 0.59 g of n-octyl-3-mercaptopropionic acid ester, and subsequently, 70.0 g of the releasing agent represented by the above mentioned formula 19) (hereinafter referred to as "Releasing agent (19)" and 0.03 g of a exemplified compound No. 1 of the Formula 1 were added to the monomer mix solution and was then dissolved while heated to 90° C., whereby a monomer solution 1 was prepared.

Separately, a surface active agent solution prepared by dissolving 1.0 g of the anionic surface active agent A in 1,560 ml of deionized water was heated to 98° C. Subsequently, 28 g of the Resin Particles (1H) as a solid, which were employed as a dispersion of nucleus particles, was added to the resulting surface active agent solution. The resulting mixture was mixed with the monomer solution 1 and dispersed for 8 hours, employing a mechanical homogenizer "Clearmix" (manufactured by M-Technique Co., Ltd.), whereby a dispersion (an emulsion composition), comprising emulsified particles (oil droplets) having dispersion particle diameter of 284 nm was prepared.

Then to the dispersion (emulsion), a polymerization initiator solution composed of 5 g of the polymerization initiator KPS and 200 ml of ion-exchanged water was added. This system was heated and stirred at 98° C. for 12 hours so as to perform polymerization (the second step polymerization). Thus latex or a dispersion of complex resin particles, which is comprised of high molecular weight resin particles each covered with the medium molecular weight resin, was prepared; the latex was referred to as Latex 1HM.

3. Formation of the Outer Layer (the Third Step of Polymerization)

An initiator solution composed of 6.8 g of the polymerization initiator KPS and 265 ml of ion-exchanged water was added to the above-obtained Latex 1HM. To thus obtained dispersion, a monomer mixture liquid composed of 249 g of styrene, 88.2 g of n-butyl acrylate, 19.4 g of methacrylic acid and 7.45 g of n-octyl 3-methylmercatopropionate was dropped spending for 1 hour at a temperature of 80° C. After the completion of the dropping, polymerization (the third step of polymerization) was performed for 2 hours while heating and stirring. Then the suspension was cooled by 28° C. Thus a latex was obtained, which is a dispersion of resin particles each having the core of the high molecular weight resin, the interlayer of the medium molecular weight resin containing Exemplified Compound (1) of the Formula 1, and the outer layer of the low molecular weight resin. The latex was referred to as Latex 1HML.

Preparation of Latex 1L

A polymerization initiator solution composed of 14.8 g of the polymerization initiator, potassium persulfate KPS, dissolved 400 g ion-exchanged water was added and heated by 80° C. The a monomer mixture liquid composed of 600 g of styrene, 190 g of n-butyl acrylate, 30 g of acrylic acid and 25 g of n-octyl 3-mercaptopropionate was dropped into the surfactant solution and heated and stirred for 2 hours at 80° C. to perform polymerization. Thus obtained dispersion was referred to as Latex 1L.

The resin particle constituting Latex 1L had peaks of molecular weight at 11,000, and the weight average diameter of the complex resin particle was 128 nm.

(Dispersing of Colorant)

In 1,600 ml of ion-exchanged water, 90 g of the anionic Surface Active Agent A was dissolved by stirring, and then 400.0 g of carbon black "REGAL 330R" was gradually added while stirring. Thereafter, the pigment was dispersed by a stirring machine CLEARMIX manufactured by M-Technique Co., Ltd. Thus a dispersion of colorant particles, hereinafter referred to as Colorant Dispersion 1, was prepared. The particle diameter of the colorant particle was 110 nm which was measured by an electrophoresis light scattering photometer ELS 800, manufactured by OTSUKA ELECTRONICS CO., LTD.

(Coagulation, Fusion-adhesion Process)

Into a reaction vessel or a four mouth flask to which a thermo sensor, cooler, nitrogen gas introducing device and stirring device were attached, 420.7 g of Latex 1HML in terms of solid ingredients, 900 g of ion-exchanged water and Colorant Dispersion 1 were charged and stirred. The temperature of the contents of the flask was adjusted to 30° C. Then 5 moles per liter aqueous solution of sodium hydroxide was added so as to make the pH value of 9.0.

Thereafter, a solution composed of 12.1 g of magnesium chloride hexahydrate and 1,000 ml of ion-exchanged water was added to the above-obtained dispersion spending 10 minutes at 30° C. while stirring. After standing for 3 minutes, the system was heated so that the temperature is attained at 90° C. spending 60 minutes. The particle size of the associated particle was measured by Coulter Counter TA-II in such the status and a solution composed of 40.2 g of sodium chloride and 1,000 of ion-exchanged water was added at the time at which the number average particle diameter were attained at 5.0 $\mu$m to stop the growing of the particle. The heating and stirring were further continued 2 hours at 98° C. as a ripening treatment for continuing the fusion-adhering of the particles. It was cooled by 30° C. at 8° C./min.

(Shell Forming Procedure)

After the above-described treatment of the coagulation, fusion-adhering and association, 96 g of Latex 1L was added to the obtained particles and heating and stirring were continued for 3 hours so that the Latex 1L was fusion-adhered onto the associated particle of Latex 1HML. Then 40.2 g of sodium chloride was added and the system was cooled by 30° C. in a rate of 8° C., and the pH was adjusted to 2.0 by the addition of hydrochloric acid, and the stirring was stopped.

Thus produced salted, coagulated and fusion-adhered particles were filtered and washed by using ion-exchanged water at 45° C. in an amount of 100 times of the solid composition of the colorant particles. After washing, filter cake was dried at 40° C. by warmed air to obtain Colored Resin Particle 1.

(Preparation of Colored Resin Particle 2)

Colored resin particles 2 was prepared in the same manner as in Colored Resin Particle 1 except that 0.03 g of the Exemplified Compound 1 of the Formula 1 used in the preparation of the Inter Layer (the second step polymerization) was replaced by 0.56 g of the Exemplified Compound 2 of the Formula 1.

(Preparation of Colored Resin Particle 3)

A mixture consisting of 165 g of styrene, 35.0 g of n-butyl acrylate, 10.0 g of carbon black, 2.0 g of di-t-butylsalicylic acid metal compound, 8.0 g of styrene-methacrylic acid copolymer, 0.14 g of the Exemplified Compound 1 of the Formula 1 and 20 g of paraffin wax (having an mp of 70° C.) was heated to 60° C. and uniformly dissolved and dispersed at 12,000 rpm, employing TK Homomixer (manufactured by Tokushu Kika Kogyo Co.). Added to the resultant mixture were 10 g of 2,2'-azobis(2,4-valeronitrile) and dissolved to prepare a polymerizable monomer composition. Subsequently, added to 710 ml of deionized water were 450 ml of 0.1 M aqueous sodium phosphate solution, and while stirring the resultant mixture at 13,000 rpm employing TK Homomixer, 68 ml of 1.0 M calcium chloride were gradually added. Thus, a suspension, in which tricalcium phosphate was dispersed, was prepared. Added to the resultant suspension was said polymerizable monomer composition and the resultant mixture was stirred at 10,000 rpm for 20 minutes, employing TK Homomixer. Thus said polymerizable monomer composition was granulated. Thereafter, the granulated composition underwent reaction at 80° C. for 10 hours. Subsequently, tricalcium phosphate was removed employing hydrochloric acid, and classification was then carried out in the liquid employing a centrifuge. Subsequently, filtering, washing and drying were carried out to obtain the Colored Resin Particle 3.

(Preparation of Colored Resin Particle 4)

Colored Resin Particle 4 was prepared in the same way as the Colored Resin Particle 1, except that the amount of the exemplified compound 1 used in the formation of the inter layer (second step polymerization process) was varied to 2.83 g.

(Preparation of Colored Resin Particle 5)

Colored Resin Particle 5 was prepared in the same way as the Colored Resin Particle 1, except that the amount of the exemplified compound 1 used in the formation of the inter layer (second step polymerization process) was varied to 0.006 g.

(Preparation of Colored Resin Particle 6)

Colored Resin Particle 6 was prepared in the same way as the Colored Resin Particle 1, except that the amount of the exemplified compound 1 used in the formation of the inter layer (second step polymerization process) was varied to 0.006 g.

(Preparation of Colored Resin Particle 7)

Colored Resin Particle 7 was prepared in the same way as the Colored Resin Particle 1, except that the amount of the exemplified compound 1 used in the formation of the inter layer (second step polymerization process) was varied to 0.006 g.

(Preparation of Comparative Colored Resin Particle 1)

Comparative Colored Resin Particle 1 was prepared in the same way as the Colored Resin Particle 1, except that the exemplified compound 1 used in the formation of the inter layer (second step polymerization process) was omitted.

(Preparation of Toners and Developers)

Each of the above-prepared Colored Resin Particles 1 through 7 and the Comparative Colored Resin Particle 1 was mixed with 1.0% by weight of hydrophobic silica having a number average primary particle diameter of 12 nm and a hydrophobilized degree of 68 and hydrophobic titanium oxide having a number average primary particle diameter of 20 nm and a hydrophobilized degree of 63 by a Henschel mixer to prepare Toners for developing static latent image 1 through 7 and Comparative Toner 1.

Each of the Toners 1 through 7 and the Comparative Toner 1 was mixed with silicone coated ferrite carrier having a volume average diameter of 60 μm so that the toner concentration was to be made to 6% to prepare Developers 1 through 7 and Comparative Developer 1, respectively.

The toners thus obtained are specified in Table 1.

TABLE 1

| | Compound | | | | |
|---|---|---|---|---|---|
| Toner No. | Exemplified Compound No. | Content Ratio (percent by weight) | Production Method | *1 | Remarks |
| 1 | 1 | 0.005 | emulsion polymerization | 5.0 | Inv. |
| 2 | 2 | 0.10 | emulsion polymerization | 6.0 | Inv. |
| 3 | 1 | 0.06 | suspension polymerization | 7.0 | Inv. |
| 4 | 1 | 0.50 | emulsion polymerization | 7.0 | Inv. |
| 5 | 1 | 0.001 | emulsion polymerization | 7.0 | Inv. |
| 6 | 1 | 1.00 | emulsion polymerization | 7.0 | Inv. |
| 7 | 1 | 1.05 | emulsion polymerization | 7.0 | Inv. |
| Comparative 1 | — | — | emulsion polymerization | 7.0 | Comp. |

<<Evaluation of Each Characteristic>>

(Evaluation of Storage Stability of Toner)

Placed in a sampling tube was 2 g of each toner prepared as above. After shaking the tube 500 times employing a tapping denser, the resulting tube was allowed to stand for two hours under an ambience of 55° C. and 35 percent relative humidity. Subsequently, the resulting toner was placed in a 48 mesh sieve and was sieved under definite vibration conditions. The ratio (in percent by weight) of the residual toner in the sieve was determined. The resulting ratio was designated as toner coagulation ratio and the storage stability of the toner was evaluated based on the criteria described below.

A: the toner coagulation ratio was less than 15 percent by weight (the storage stability of the toner was termed excellent)

B: the toner coagulation ratio was from 15 to 45 percent by weight (the storage stability of the toner was termed good)

C: the toner coagulation ratio was from 46 to 60 percent by weight (the storage stability of the toner was in the commercially viable range)

D: the toner coagulation ratio exceeded 60 percent by weight (the storage stability of the toner was not commercially viable)

(Evaluation of Off-setting Resistance)

Image off-setting and heating roller stain were evaluated employing a modified fixing apparatus of a digital copier, Konica Sitios® 7065, manufactured by Konica Corp.

The fixing apparatus was modified in such a manner that the cleaning mechanism and the like which could come into contact with the heating roller were removed so that nothing could come into contact with the heating roller. An ambience during copying was set at normal temperature and normal pressure (25° C. and 55 percent relative humidity). The surface temperature of the arranged heating roller for fixing was varied in increments of 10° C. in the range of 150 to 180° C. At each surface temperature, A4 size plain paper sheets, having 5 mm wide solid black belt-shaped images at the right angle position with respect to the conveying direction were longitudinally conveyed and subsequently fixed. Thereafter, A4 size plain paper sheets, having 5 mm wide solid black belt-shaped images and 20 mm wide halftone images at the right angle position with respect to the conveying direction were laterally conveyed. Each of the obtained samples was visually inspected with regard to image stain (image off-setting) due to fixing off-setting and toner stain on the heating roller surface. Off-setting resistance was then evaluated based on the criteria described below.

A: neither image off-setting nor toner stain on the heating roller surface was noticed B: both image off-setting and toner stain on the heating roller surface were barely noticed C: image off-setting was not noticed but toner stain on the heating roller surface was noticed D: both image off-setting and toner stain on the heating roller surface were noticed E: image off-setting was clearly noticed and the heating roller surface was markedly stained In the above mentioned evaluation ranking, it was judged that A and B were in the range of commercial viability.

Table 2 shows these results.

TABLE 2

| | Toner Storage | Off-Setting Resistance (Fixing Temperature: ° C.) | | | | | | | |
|---|---|---|---|---|---|---|---|---|---|
| Toner No. | Stability | 150 | 155 | 160 | 165 | 170 | 175 | 180 | Remarks |
| 1 | A | A | A | A | A | A | A | A | Inv. |
| 2 | A | A | A | A | A | A | A | A | Inv. |
| 3 | A | A | A | A | A | A | A | A | Inv. |
| 4 | A | B | A | A | A | A | A | A | Inv. |
| 5 | A | B | B | A | A | A | A | A | Inv. |
| 6 | B | A | A | A | A | A | A | A | Inv. |
| 7 | C | A | A | A | A | A | A | A | Inv. |
| Comp. 1 | A | D | D | C | B | B | A | A | Comp. |

Inv.; Present Invention

Comp.; Comparative Example

Example 2

Preparation of Toners 8–13 and Comparative Toners 2–4

Preparation of Colored Particle 8

(Preparation of Latex)

(1) Preparation of Nucleus Particles (One Step Polymerization)

Charged into a 5,000 ml separable flask fitted with a stirring unit, a temperature sensor, a cooling pipe, and a nitrogen inlet unit was a surface active agent solution (a water-based medium) which was prepared by dissolving 4.0 g of an anionic surface active agent A ($C_{10}H_{21}(OCH_2CH_2)_2OSO_3Na$ in 3,040 g of deionized water. Subsequently, while stirring at 230 rpm, temperature in the flask was raised to 80° C. under a flow of nitrogen.

Added to the resulting surface active agent solution was an initiator solution prepared by dissolving 10.0 g of a polymerization initiator (potassium persulfate: KPS) in 200 g of deionized water, and subsequently, the resulting mixture was heated to 75° C. Thereafter, a monomer mix solution, comprised of 528 g of styrene, 204 g of n-butyl acrylate, and 68.0 g of methacrylic acid, was added dropwise over one hour. While stirring, the resulting system underwent polymerization (first step polymerization) while heated to 75° C. for two hours, whereby resin particles (a dispersion of resin particles comprised of a high molecular weight resin) were prepared. The resulting particles were designated as "Latex (2H)".

(2) Formation of the Interlayer (the Second Step Polymerization)

Charged into a flask fitted with a stirring unit were 95.0 g of styrene, 36.0 g of n-butyl acrylate, 9.0 g of methacrylic acid, and 0.59 g of n-octyl-3-mercaptopropionic acid ester, and subsequently, 70.0 g of the releasing agent (19) was added to the monomer mix solution and was then dissolved while heated to 90° C., whereby a monomer solution 2 was prepared.

Separately, a surface active agent solution prepared by dissolving 1.0 g of the anionic surface active agent A in 1,560 ml of deionized water was heated to 98° C. Subsequently, 28 g of the Resin Particles (2H) as a solid, which were employed as a dispersion of nucleus particles, was added to the resulting surface active agent solution. The resulting mixture was mixed with the monomer solution 2 and dispersed for 8 hours, employing a mechanical homogenizer "Clearmix" (manufactured by M-Technique Co., Ltd.), whereby a dispersion (an emulsion composition), comprising emulsified particles (oil droplets) having dispersion particle diameter of 284 nm was prepared.

Then to the dispersion (emulsion), a polymerization initiator solution composed of 5 g of the polymerization initiator KPS and 200 ml of ion-exchanged water was added. This system was heated and stirred at 98° C. for 12 hours so as to perform polymerization (the second step polymerization). Thus latex or a dispersion of complex resin particles, which is comprised of high molecular weight resin particles each covered with the medium molecular weight resin, was prepared; the latex was referred to as Latex 2HM.

3. Formation of the Outer Layer (the Third Step of Polymerization)

An initiator solution composed of 6.8 g of the polymerization initiator KPS and 265 ml of ion-exchanged water was added to the above-obtained Latex 2HM. To thus obtained dispersion, a monomer mixture liquid composed of 249 g of styrene, 88.2 g of n-butyl acrylate, 19.4 g of methacrylic acid and 7.45 g of n-octyl 3-methylmercatopropionate was dropped spending for 1 hour at a temperature of 80° C. After the completion of the dropping, polymerization (the third step of polymerization) was performed for 2 hours while heating and stirring. Then the suspension was cooled by 28° C. Thus a latex was obtained, which is a dispersion of resin particles each having the core of the high molecular weight resin, the interlayer of the medium molecular weight resin containing Exemplified Compound (1) of the Formula 1, and the outer layer of the low molecular weight resin. The latex was referred to as Latex 2HML.

Ion-exchanged water was added to the reaction vessel containing the prepared Latex 1HML so as to have concentration of the Surface active agent A of less than critical micelle concentration, and 0.4 g of isopropyl benzene (exemplified compound 6) was added after the temperature was heated up to 80° C. These were stirred at 80° C. for 3 hours so as to complete the incorporation of isopropyl benzene in the Latex 1HML, then were cooled to 28° C. to obtain Latex A.

Preparation of Latex 2L

A polymerization initiator solution composed of 14.8 g of the polymerization initiator, potassium persulfate KPS, dissolved 400 g ion-exchanged water was added and heated by 80° C. The a monomer mixture liquid composed of 600 g of styrene, 190 g of n-butyl acrylate, 30 g of acrylic acid and 25 g of n-octyl 3-mercaptopropionate was dropped into the surfactant solution and heated and stirred for 2 hours at 80° C. to perform polymerization. Thus obtained dispersion was referred to as Latex 2L.

The resin particle constituting Latex 2L had peaks of molecular weight at 11,000, and the weight average diameter of the complex resin particle was 128 nm.

(Coagulation, Fusion-adhesion Process)

Into a reaction vessel or a four mouth flask to which a thermo sensor, cooler, nitrogen gas introducing device and stirring device were attached, 420.7 g of Latex A in terms of solid ingredients, 900 g of ion-exchanged water and Colorant Dispersion 1 were charged and stirred. The temperature of the contents of the flask was adjusted to 30° C. Then 5 moles per liter aqueous solution of sodium hydroxide was added so as to make the pH value of 9.0.

Thereafter, a solution composed of 12.1 g of magnesium chloride hexahydrate and 1,000 ml of ion-exchanged water was added to the above-obtained dispersion spending 10 minutes at 30° C. while stirring. After standing for 3 minutes, the system was heated so that the temperature is attained at 90° C. spending 60 minutes. The particle size of the associated particle was measured by Coulter Counter TA-II in such the status and a solution composed of 40.2 g of sodium chloride and 1,000 of ion-exchanged water was added at the time at which the number average particle diameter were attained at 5.0 $\mu$m to stop the growing of the particle. The heating and stirring were further continued 2 hours at 98° C. as a ripening treatment for continuing the fusion-adhering of the particles. It was cooled by 30° C. at 8° C./min.

(Shell Forming Procedure)

After the above-described treatment of the coagulation, fusion-adhering and association, 96 g of Latex 2L was added to the obtained particles and heating and stirring were continued for 3 hours so that the Latex 2L was fusion-adhered onto the associated particle of Latex A. Then 40.2 g of sodium chloride was added and the system was cooled by 30° C. in a rate of 8° C., and the pH was adjusted to 2.0 by the addition of hydrochloric acid, and the stirring was stopped.

Thus produced salted, coagulated and fusion-adhered particles were filtered and washed by using ion-exchanged water at 45° C. in an amount of 100 times of the solid composition of the colorant particles. After washing, filter cake was dried at 40° C. by warmed air to obtain Colored Resin Particle 8.

(Preparation of Colored Resin Particle 9)

Colored resin particles 9 was prepared in the same manner as in Colored Resin Particle 8 except that the amount of isopropyl alcohol was changed to 0.4 g of α-methylstyrene (Exemplified compound 9) in place of isopropyl benzene.

(Preparation of Colored Resin Particle 10)

Colored resin particles 10 was prepared in the same manner as in Colored Resin Particle 8 except that the amount of n-octyl-3-mercapto propionate was changed to 5.0 g, and 2.0 g and α-methylstyrene dimer was added.

(Preparation of Colored Resin Particle 11)

Colored resin particles 11 was prepared in the same manner as in Colored Resin Particle 8 except that the amount of isopropyl alcohol was changed to 0.006 g.

(Preparation of Colored Resin Particle 12)

Colored resin particles 12 was prepared in the same manner as in Colored Resin Particle 8 except that the amount of isopropyl alcohol was changed to 1.65 g.

(Preparation of Colored Resin Particle 13)

A mixture consisting of 165 g of styrene, 35.0 g of n-butyl acrylate, 10.0 g of carbon black, 2.0 g of di-t-butylsalicylic acid metal compound, 8.0 g of styrene-methacrylic acid copolymer, 0.02 g of isopropyl benzene and 20 g of paraffin wax (having an mp of 70° C.) was heated to 60° C. and uniformly dissolved and dispersed at 12,000 rpm, employing TK Homomixer (manufactured by Tokushu Kika Kogyo Co.). Added to the resultant mixture were 10 g of 2,2'-azobis (2,4-valeronitrile) and dissolved to prepare a polymerizable monomer composition. Subsequently, added to 710 ml of deionized water were 450 ml of 0.1 M aqueous sodium phosphate solution, and while stirring the resultant mixture at 13,000 rpm employing TK Homomixer, 68 ml of 1.0 M calcium chloride were gradually added. Thus, a suspension, in which tricalcium phosphate was dispersed, was prepared. Added to the resultant suspension was said polymerizable monomer composition and the resultant mixture was stirred at 10,000 rpm for 20 minutes, employing TK Homomixer. Thus said polymerizable monomer composition was granulated. Thereafter, the granulated composition underwent reaction at 80° C. for 10 hours. Subsequently, tricalcium phosphate was removed employing hydrochloric acid, and classification was then carried out in the liquid employing a centrifuge. Subsequently, filtering, washing and drying were carried out to obtain the Colored Resin Particle 13.

(Preparation of Comparative Colored Resin Particle 2)

Comparative Colored Resin Particle 2 was prepared in the same way as the Colored Resin Particle 8, except that isopropyl alcohol was omitted.

(Preparation of Comparative Colored Resin Particle 3)

Comparative Colored Resin Particle 3 was prepared in the same way as the Colored Resin Particle 8, except that amount of isopropyl alcohol was changed to 6.00 g.

(Preparation of Comparative Colored Resin Particle 4)

Comparative Colored Resin Particle 4 was prepared in the same way as the Colored Resin Particle 8, except that isopropyl alcohol was replaced by 6.00 g of α-methylstyrene.

(Preparation of Toners and Developers)

Each of the above-prepared Colored Resin Particles 8 through 14 and the Comparative Colored Resin Particles 2 through 4 were mixed with 1.0% by weight of hydrophobic silica having a number average primary particle diameter of 12 nm and a hydrophobilized degree of 68 and hydrophobic titanium oxide having a number average primary particle diameter of 20 nm and a hydrophobilized degree of 63 by a Henschel mixer to prepare Toners for developing static latent image 8 through 14 and Comparative Toners 2 through 4.

Each of the Toners 8 through 14 and Comparative Toners 2 through 4 was mixed with silicone coated ferrite carrier having a volume average diameter of 60 μm so that the toner concentration was to be made to 6% to prepare Developers 8 through 14 and Comparative Developers 2 through 4, respectively.

An amount of aromatic hydrocarbon compound in each of toners other than Comparative Toner 2 was measured by the head space system gas chromatography. The Toner 10 contains 0.007 percent by weight of isopropyl benzene and 0.002 percent by weight of methyl styrene. The result other than Toner 10 is shown in Table 3.

Specification of each Toner is also shown in Table 3.

TABLE 3

| | Compound | | | | |
|---|---|---|---|---|---|
| Toner No. | Exemplified Compound No. | Content Ratio (percent by weight) | Production Method | Re-*1 | marks |
| 8 | 6 | 0.007 | emulsion polymerization | 5.0 | Inv. |
| 9 | 9 | 0.006 | emulsion polymerization | 6.0 | Inv. |
| 10 | 6 and 9 | 0.009 | emulsion polymerization | 6.0 | Inv. |
| 11 | 6 | 0.001 | emulsion polymerization | 6.0 | Inv. |
| 12 | 6 | 0.30 | emulsion polymerization | 6.0 | Inv. |
| 13 | 6 | 0.007 | suspension polymerization | 7.0 | Inv. |
| Comparative 2 | — | — | emulsion polymerization | 6.0 | Comp. |
| Comparative 3 | 6 | 1.10 | emulsion polymerization | 6.0 | Comp. |
| Comparative 4 | 9 | 1.10 | emulsion polymerization | 6.0 | Comp. |

*1; Average Particle Diameter of Toner D50 (μm)m)
Inv.; Present Invention Comp.; Comparative Example <<Evaluation of Each Characteristic>>

(Evaluation of Storage Stability of Toner)

Placed in a sampling tube was 2 g of each toner prepared as above. After shaking the tube 500 times employing a tapping denser, the resulting tube was allowed to stand for two hours under an ambience of 55° C. and 35 percent relative humidity. Subsequently, the resulting toner was placed in a 48 mesh sieve and was sieved under definite vibration conditions. The ratio (in percent by weight) of the residual toner in the sieve was determined. The resulting ratio was designated as toner coagulation ratio and the storage stability of the toner was evaluated based on the criteria described below.

A: the toner coagulation ratio was less than 15 percent by weight (the storage stability of the toner was termed excellent)

B: the toner coagulation ratio was from 15 to 45 percent by weight (the storage stability of the toner was termed good)

C: the toner coagulation ratio was from 46 to 60 percent by weight (the storage stability of the toner was in the commercially viable range)

D: the toner coagulation ratio exceeded 60 percent by weight (the storage stability of the toner was not commercially viable)

(Evaluation of Off-setting Resistance)

Image off-setting and heating roller stain were evaluated employing a modified fixing apparatus of a digital copier, Konica Sitios 7065, manufactured by Konica Corp.

The fixing apparatus was modified in such a manner that the cleaning mechanism and the like which could come into contact with the heating roller were removed so that nothing could come into contact with the heating roller. An ambience during copying was set at normal temperature and normal pressure (25° C. and 55 percent relative humidity). The surface temperature of the arranged heating roller for fixing was varied in increments of 10° C. in the range of 150 to 180° C. At each surface temperature, A4 size plain paper sheets, having 5 mm wide solid black belt-shaped images at the right angle position with respect to the conveying direction were longitudinally conveyed and subsequently fixed. Thereafter, A4 size plain paper sheets, having 5 mm wide solid black belt-shaped images and 20 mm wide halftone images at the right angle position with respect to the conveying direction were laterally conveyed. Each of the obtained samples was visually inspected with regard to image stain (image off-setting) due to fixing off-setting and toner stain on the heating roller surface. Off-setting resistance was then evaluated based on the criteria described below.

A: neither image off-setting nor toner stain on the heating roller surface was noticed B: both image off-setting and toner stain on the heating roller surface were barely noticed C: image off-setting was not noticed but toner stain on the heating roller surface was noticed D: both image off-setting and toner stain on the heating roller surface were noticed E: image off-setting was clearly noticed and the heating roller surface was markedly stained In the evaluation ranking, it was judged that A and B were in the range of commercial viability.

(Evaluation of Fixability)

(Image Output)

Images for evaluating the fixing ratio were prepared as follows. By employing a digital copier, Konica Sitios 7065, manufactured by Konica Corp., a solid black toner image was transferred onto a 200 g/m$^2$ fine-quality paper sheet to obtain an adhered toner amount of 0.6 g/cm$^2$ by adjusting the density, and was subsequently fixed.

<Measurement of Fixing Ratio>

The fixing strength of the resulting fixed images was evaluated based on the fixing ratio which was determined according to the Mending Tape Peeling Method, described in Chapter 9 Item 1.4 in "Denshishashin no Kiso to Oyo: Denshishashin Gakkai Hen (Base and Application of Electrophotographic Technology: Edited by Denshishashin Gakkai)".

The specific measurement procedure of the fixing ratio is described below. A 2.5 cm square solid black image was cut from the image to measure the fixing ratio. Subsequently, "Scotch Mending Tape", manufactured by Sumitomo 3M Limited, was adhered onto the image and peeled off. Image density prior to and after peeling of the tape was measured and the fixing ratio was obtained employing the formula described below.

Fixing ratio (percent)=(image density after peeling/image density prior to peeling)×100

Incidentally, image density was measured employing a Reflection Densitometer RD-918, manufactured by Macbeth Corp.

The fixing ratio, obtained as above, was evaluated based on the criteria described below.

A: the fixing ratio was at least 90 percent (fixability was considered to be excellent)

B: the fixing ratio was from 80 to 90 percent (fixability was considered to be good and was considered in the commercial viable range C: the fixing ratio was less than 80 percent (fixability was considered to be poor and was beyond the commercially viable range Table 4 shows these results.

TABLE 4

| Toner No. | Toner Storage Stability | Off-Setting Resistance (Fixing Temperature: ° C.) 150 | 160 | 170 | 180 | Fix-ability | Re-marks |
|---|---|---|---|---|---|---|---|
| 8 | A | A | A | A | A | A | Inv. |
| 9 | A | A | A | A | A | A | Inv. |
| 10 | A | A | A | A | A | A | Inv. |
| 11 | A | B | A | A | A | A | Inv. |
| 12 | B | A | A | A | A | A | Inv. |
| 13 | A | A | A | A | A | A | Inv. |
| Comparative 2 | A | D | C | B | A | D | Comp. |
| Comparative 3 | D | D | C | A | A | D | Comp. |
| Comparative 4 | D | D | C | A | A | D | Comp. |

Inv.; Present Invention
Comp.; Comparative Example

As can clearly be seen from Table 4, samples which employ toners, comprising compounds according to the present invention, exhibited excellent storage stability of toner and also inhibited excellent off-setting resistance as well as excellent fixability even while fixed at a relatively low temperature, compared to comparative samples.

The present invention is capable of providing electrostatic image developing toner which exhibits excellent storage stability and is applicable to t a wide range of fixing temperatures, and also exhibits excellent off-setting resistance as well as excellent fixability even in a low temperature range, a production method thereof, and an image forming method.

What is claimed is:

1. An electrostatic image developing toner comprising a colored particle comprising a binder resin and a colorant, wherein the colored particle comprises a compound represented by Formula (1) in an amount of 0.001 to 1.0 percent by weight based on the colored particle:

Ar-L-R Formula (1)

in the formula Ar is an aryl group, R is an aryl or alkyl group and L is —$CH_2$—, —$(CH_2)_2$—,

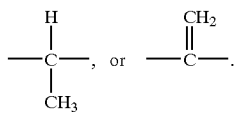

2. The electrostatic image developing toner of claim 1, wherein the compound is diphenylmethane, 1,1-diphenyl ethylene, diphenylethane, dinaphtylmethane, dinaphtylethane, isopropyl benzene or α-methylstyrene.

3. The electrostatic image developing toner of claim 2, wherein the compound is diphenylmethane, 1,1-diphenylethylene, isopropyl benzene or α-methylstyrene.

4. The electrostatic image developing toner of claim 1, wherein the resin is produced by polymerizing a polymerization monomer in a water based medium.

5. An image forming method comprising forming an electrostatic image on an electrostatic image bearing body;

developing the electrostatic image to form a toner image by developer;

and transferring the toner image onto a transfer body; wherein the developer comprises an electrostatic image developing toner of claim 1.

6. The electrostatic image developing toner of claim 1, wherein the Ar represents a phenyl group or a naphthyl group which have or do not have a substituent of an aliphatic hydrocarbon group having 1 to 10 carbon atoms, and the R is an aryl group or an aliphatic hydrocarbon group having 1 to 10 carbon atoms.

7. The electrostatic image developing toner of claim 6, wherein the amount of the compound represented by Formula (1) is in an amount of 0.003 to 0.1 percent by weight based on the colored particle.

8. The electrostatic image developing toner of claim 1, wherein the amount of the compound represented by Formula (1) is in an amount of 0.003 to 0.1 percent by weight based on the colored particle.

9. The electrostatic image developing toner of claim 1, wherein the amount of the compound represented by Formula (1) is in an amount of 0.005 to 0.1 percent by weight based on the colored particle.

10. The electrostatic image developing toner of claim 1, comprising a compound represented by Formula $R_1$—$(OCO—R_2)_n$, wherein $R_1$ and $R_2$, each represents hydrocarbon group having 1 to 40 carbon atoms and each may have the substituent, and n is the integer of 1–4.

11. The image forming method of claim 5, wherein the forming step comprises:

forming a latent image corresponding to a yellow image on a second electrostatic image bearing body, forming a latent image corresponding to a magenta image on a third electrostatic image bearing body, forming a latent image corresponding to a cyan image on a fourth electrostatic image bearing body, and forming a latent image corresponding to a black image on the electrostatic image bearing body;

the developing step comprises developing the latent image by a yellow toner to form a yellow toner image on the second latent image bearing body, developing the latent image by a magenta toner to form a magenta toner image on the third latent image bearing body, developing the latent image by a cyan toner to form a cyan toner image on the fourth latent image bearing body, and developing the latent image by a black color of the electrostatic image developing toner of claim 1 to form a black toner image on the latent image bearing body, transferring each of the yellow, cyan, magenta and black toner images to an intermediate transfer body.

12. The image forming method of claim 11, wherein the Ar represents a phenyl group or a naphthyl group which have or do not have a substituent of an aliphatic hydrocarbon group having 1 to 10 carbon atoms, and the R is an aryl group or an aliphatic hydrocarbon group having 1 to 10 carbon atoms.

13. The image forming method of claim 12, wherein the amount of the compound represented by Formula (1) is in an amount of 0.003 to 0.1 percent by weight based on the colored particle.

14. The image forming method of claim 13, comprising a compound represented by Formula $R_1$—$(OCO—R_2)_n$, wherein $R_1$ and $R_2$, each represents hydrocarbon group having 1 to 40 carbon atoms and each may have the substituent, and n is an integer of 1–4.

* * * * *